US005487333A

United States Patent [19]

Oshio et al.

[11] Patent Number: 5,487,333

[45] Date of Patent: Jan. 30, 1996

[54] STENCIL PRINTING DEVICE EQUIPPED WITH A STENCIL MASTER PLATE EJECTING DEVICE

[75] Inventors: Susumu Oshio; Tadayuki Igarashi, both of Tokyo, Japan

[73] Assignee: Riso Kagaku Corporation, Tokyo, Japan

[21] Appl. No.: 203,577

[22] Filed: Mar. 1, 1994

[30] Foreign Application Priority Data

Mar. 5, 1993 [JP] Japan ..... 5-045418

[51] Int. Cl.[6] ..... B41L 13/06

[52] U.S. Cl. ..... 101/116; 101/118; 101/120; 101/128.4

[58] Field of Search ..... 101/116, 720, 101/123, 124, 128.4; 400/703

[56] References Cited

U.S. PATENT DOCUMENTS

| | | | |
|---|---|---|---|
| 4,628,813 | 12/1986 | Hasegawa et al. | 101/116 |
| 4,783,616 | 11/1988 | Brasa | 101/116 |
| 4,834,563 | 5/1989 | Ozawa et al. | 400/703 |
| 4,881,104 | 11/1989 | Kusumoto et al. | 271/256 |
| 4,996,568 | 2/1991 | Hamakawa | 271/256 |
| 5,140,898 | 8/1992 | Igarashi | 101/120 |
| 5,184,186 | 2/1993 | Kida | 271/256 |
| 5,224,419 | 7/1993 | Fukai | 101/128.4 |
| 5,230,573 | 7/1993 | Yasuoka et al. | 400/708 |
| 5,255,598 | 10/1993 | van Sas et al. | 101/118 |

OTHER PUBLICATIONS

Patent Abstracts Of Japan, vol. 4, No. 64 (M-011) 5 Mar. 1980 (JP-A-55 030 922).

Patent Abstracts Of Japan, vol. 12, No. 164 (M-698) 4 Dec. 1987 (JP-A-62 279 979).

*Primary Examiner*—Edgar S. Burr
*Assistant Examiner*—Lynn D. Hendrickson
*Attorney, Agent, or Firm*—Dickstein, Shapiro & Morin

[57] ABSTRACT

To the end of reliably and accurately detecting a failure to properly eject a master plate and positively preventing the occurrence of secondary failures due to a failure to properly eject a master plate, the passage of both the leading edge and the trailing edge of the ejected master plate beyond a prescribed point in the conveying path of ejected master plates is used as an indication of a successful ejection of a master plate. An ejected master plate sensor for detecting the presence of a master plate in a path for conveying a stencil master plate to an ejected master plate receiving box is provided in the conveying path, and the state of the ejected master plate sensor is monitored if the change of its state from the one indicating the absence of a master plate to the one indicating the presence of a master plate is followed within a prescribed time period by the change of its state from the one indicating the presence of a master plate to the one indicating the absence of a master plate so that a start of a next operation may be permitted when such a sequence of the change of the state of the stencil master plate detecting sensor took place, and a start of a next operation may be otherwise prohibited as being a case of a failure to properly eject a stencil master plate.

8 Claims, 4 Drawing Sheets

STENCIL PRINTING DEVICE EQUIPPED WITH A STENCIL MASTER PLATE EJECTING DEVICE

TECHNICAL FIELD

The present invention relates to a stencil printing device equipped with a stencil master plate ejecting device, and in particular to a stencil printing device equipped with a stencil master plate ejecting device for removing a stencil master plate mounted around an outer circumferential surface of a printing drum and conveying it to an ejected master plate receiving unit.

BACKGROUND OF THE INVENTION

Already known is a stencil printing device equipped with a stencil master plate ejecting device in which a stencil master plate mounted around the outer circumferential surface of a printing drum is peeled off therefrom by using a peeling claw, and the thus removed stencil master plate is conveyed to a master plate receiving unit by master plate ejecting feed rollers. Such stencil master plate ejecting devices are disclosed for instance in Japanese utility model laid open publication (kokai) No. 58-3266 and Japanese utility model publication (kokoku) No. 04-18867.

Conventionally, such a stencil printing device is provided with stencil master plate detecting means for detecting the presence of a stencil master plate in the path of conveying stencil master plates to an ejected master plate receiving unit, and the state of the stencil master plate detecting means is monitored if it changes from the one indicating the absence of a stencil master plate to the one indicating the presence of a stencil master plate within a prescribed time period after the issuance of the command to start the operation of ejecting a stencil master plate so that a start of a next operation may be permitted when such a sequence of the change of the state of the stencil master plate detecting means took place, and a start of a next operation may be otherwise prohibited as being a case of a failure to properly eject a stencil master plate.

This process of determining the occurrence of a failure to properly eject a stencil master plate is based on the detection of the leading edge of the stencil master plate that is to be ejected as it passes through the conveying path leading to the ejected master plate receiving unit, and, therefore, the succeeding operation of the stencil printing device is permitted as if the ejection of the stencil master plate were completely executed even though it is possible that the leading edge of the stencil master plate to be ejected has passed through the conveying path leading to the ejected master plate receiving unit but may have failed to be delivered to the ejected master plate receiving unit due to some fault of the system.

If the succeeding operation of the stencil printing device is carried out without the removed stencil master plate being properly conveyed to the ejected master plate receiving unit, the rotation of the printing drum may be obstructed by the stencil master plate accidentally remaining in the master plate ejecting unit, and the stencil master plate newly mounted on the printing drum may be smeared by the ink adhering to the preceding stencil master plate which failed to be properly ejected. Furthermore, the previous stencil master plate accidentally remaining in the master plate ejecting unit will prevent the proper ejection of the succeeding stencil master plates, and the fault in the master plate ejecting unit will be progressively worsened, eventually requiring a major servicing work to restore the stencil printing device into its properly operable condition.

BRIEF SUMMARY OF THE INVENTION

The present invention was made in view of such problems of the prior art, and its primary object is to provide a stencil printing device equipped with an improved master plate ejecting device which can accurately and properly identify the case of a failure to properly eject a stencil master plate.

A second object of the present invention is to provide a stencil printing device equipped with an improved master plate ejecting device which can positively prevent secondary failures due to a failure to properly eject a stencil master plate.

A third object of the present invention is to provide a stencil printing device equipped with an improved master plate ejecting device which is additionally provided with the function to warn the user in case of an occurrence of a failure to properly eject a stencil master plate.

According to the present invention, these and objects can be accomplished by providing a stencil printing device equipped with a master plate ejecting device for removing a stencil master plate mounted around an outer circumferential surface of a printing drum and conveying it to an ejected master plate receiving unit, comprising: stencil master plate detecting means for detecting presence of a stencil master plate in a path for conveying a stencil master plate to the stencil master plate receiving unit; and control means for allowing a next operation to be carried out only when it has determined from an output from the stencil master plate detecting means that a stencil master plate removed from the printing drum has passed through a prescribed point in the stencil master plate conveying path.

Thus, a failure to eject a used stencil master plate can be accurately detected, and it can be positively avoided to eject a second stencil master plate when a first stencil master is still left in the ejected stencil master plate conveying path. Therefore, it is also avoided to cause secondary failures due to the ejection of a second stencil master plate when a first stencil master plate has failed to be properly ejected and has been inadvertently left in the ejected master plate conveying path.

The proper ejection of a stencil master plate can be accurately determined if the control means monitors from an output from the stencil master plate detecting means that a trailing edge of the stencil master plate has passed the prescribed point, and, more preferably, if the control means monitors from an output from the stencil master plate detecting means that a trailing edge of the stencil master plate has passed the prescribed point followed by a passage of a leading edge of the stencil master plate within a prescribed time period.

The control means can conveniently determine the complete passage of an ejected master plate when it is detected that a change of a state of the stencil master plate detecting means from a state indicating absence of a stencil master plate to a state indicating presence of a stencil master plate is followed within the prescribed time period by a change of a state of the stencil master plate detecting means from a state indicating presence of a stencil master plate to a state indicating absence of a stencil master plate.

Preferably, the stencil printing device equipped with a stencil master plate ejecting device further comprises stencil master plate ejection failure warning means for warning a failure to properly eject a stencil master plate when such a failure is detected by the control means.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
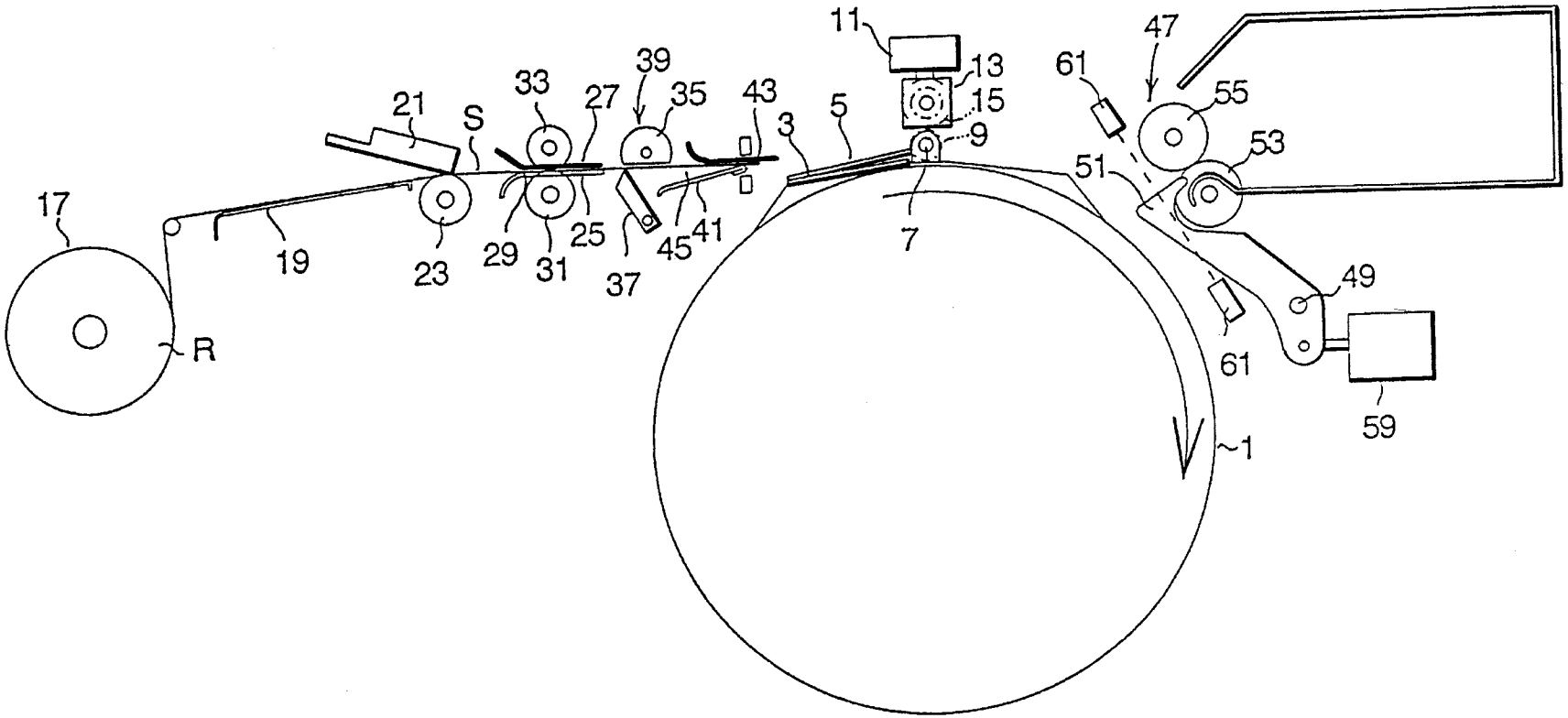
FIG. 1 is a simplified structural view of an embodiment of the stencil printing device equipped with a master plate ejecting device to which the control device of the present invention is applied.

FIG. 1 shows an embodiment of the stencil printing device equipped with a master plate ejecting device to which the control device of the present invention is applied. In FIG. 1, numeral 1 denotes a cylindrical printing drum. The printing drum 1 is provided with a master plate clamping piece 5 which clamps a stencil master plate S in cooperation with a flat surface portion 3 provided on the outer circumferential surface of the printing drum 1. A pivot shaft 7 of the master plate clamping piece 5 carries a spur gear 9 which is selectively engaged by a drive gear 15 of a clamp drive unit 13 provided on a fixed main body frame not shown in the drawing in a vertically moveable manner by virtue of a clamp solenoid 11.

To the left of the printing drum 1 as seen in FIG. 1 is provided a master plate sheet roll retaining unit 17 for exchangeably retaining a continuous roll R of heat-sensitive stencil master plate sheet S.

Between the master plate sheet roll retaining unit 17 and the printing drum 1 are provided a master plate sheet guide lower plate 19, a thermal head 21 and an associated platen roller 23 which are disposed as a vertically opposing pair to form a thermal plate making unit, a master plate sheet inlet passage 29 defined by a vertically opposing pair of a master plate sheet guide lower plate 25 and a master plate sheet guide upper plate 27, a master plate sheet cutter 39 consisting of a vertically opposing pair of a fixed cutting blade 35 and a moveable cutting blade 37, and a master plate sheet outlet passage 45 defined by a vertically opposing pair of a master plate sheet guide lower plate 41 and a master plate sheet guide upper plate 43, in that order.

To the right of the printing drum 1 as seen in the drawing is provided a master plate ejecting unit 47. The master plate ejecting unit 47 comprises a master plate ejecting claw 51 rotatably supported by a pivot shaft 49, a pair of master plate ejecting feed rollers 53 and 55 vertically opposing each other, and an ejected master plate receiving box 57 disposed to the rear (to the right as seen in FIG. 1) of the master plate ejecting feed rollers 53 and 55.

The master plate ejecting claw 51 can be rotatively actuated by a master plate ejecting claw solenoid 59 between a master plate peeling position adjacent to the outer circumferential surface of the printing drum 1 and a retracted position displaced from this master plate peeling position.

To the front of the master plate ejecting feed rollers 53 and 55 is provided an optical ejected master plate sensor 61 for detecting the presence of a master plate sheet S peeled off from the printing drum 1.

Figure 2:
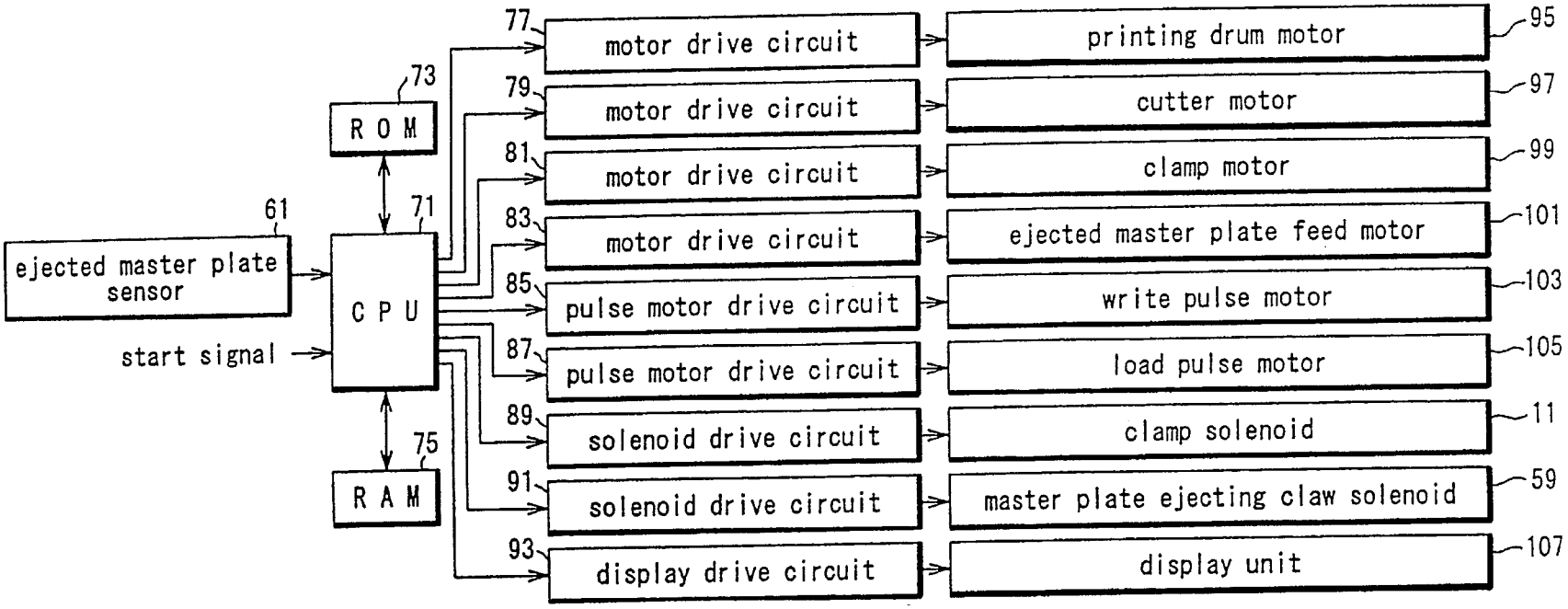
FIG. 2 is a block diagram showing an embodiment of the control system for the master plate sheet supplying unit of the stencil printing device to which the control device of the present invention is applied.

FIG. 2 shows an embodiment of a control system for the master plate sheet supplying unit of the stencil printing device having the above described structure. This control system comprises a CPU 71 consisting of a microprocessor or the like, ROM 73 storing control programs, and RAM 75 temporarily storing input information and results of timer measurements, and, according to the information supplied for the ejected master plate sensor 61, sends commands to four motor drive circuits 77, 79, 81 and 83, a pair of pulse motor drive circuits 85 and 87, a pair of solenoid drive circuits 89 and 91, and a display drive circuit 93.

The motor drive circuits 77, 79, 81 and 83 are connected to a printing drum motor 95 for rotatively driving the printing drum 1, a cutter motor 97 for rotatively driving the moveable cutting blade 37, a clamp motor 99 for rotatively driving the drive gear 15, and an ejected master plate feed motor 101 for rotatively driving the platen roller 23, respectively. The pulse motor drive circuits 85 and 87 are connected to a write pulse motor 103 for rotatively driving the platen roller 23, and a load pulse motor 105 for rotatively driving the master plate sheet conveying roller 31, respectively. The solenoid drive circuits 89 and 91 are connected to the clamp solenoid 11 and the master plate ejecting claw solenoid 59, respectively. The display drive circuit 93 is connected to a display unit 107 consisting of LCD or the like.

The CPU 71 executes control programs, and basically monitors if a change of the state of the ejected master plate sensor 61 from a state indicating absence of a stencil master plate to a state indicating presence of a stencil master plate is followed within a prescribed time period by a change of the state of the ejected master plate sensor 61 from the state indicating presence of a stencil master plate to the state indicating absence of a stencil master plate so that a start of a next operation may be permitted when such a sequence of the change of the state of the stencil master plate detecting means took place, and a start of a next operation may be otherwise prohibited as being a case of a failure to properly eject a stencil master plate at the same time as sending a command to the display drive circuit 93 to issue a warning indicating the occurrence of a failure to properly eject a master plate.

Figure 3:
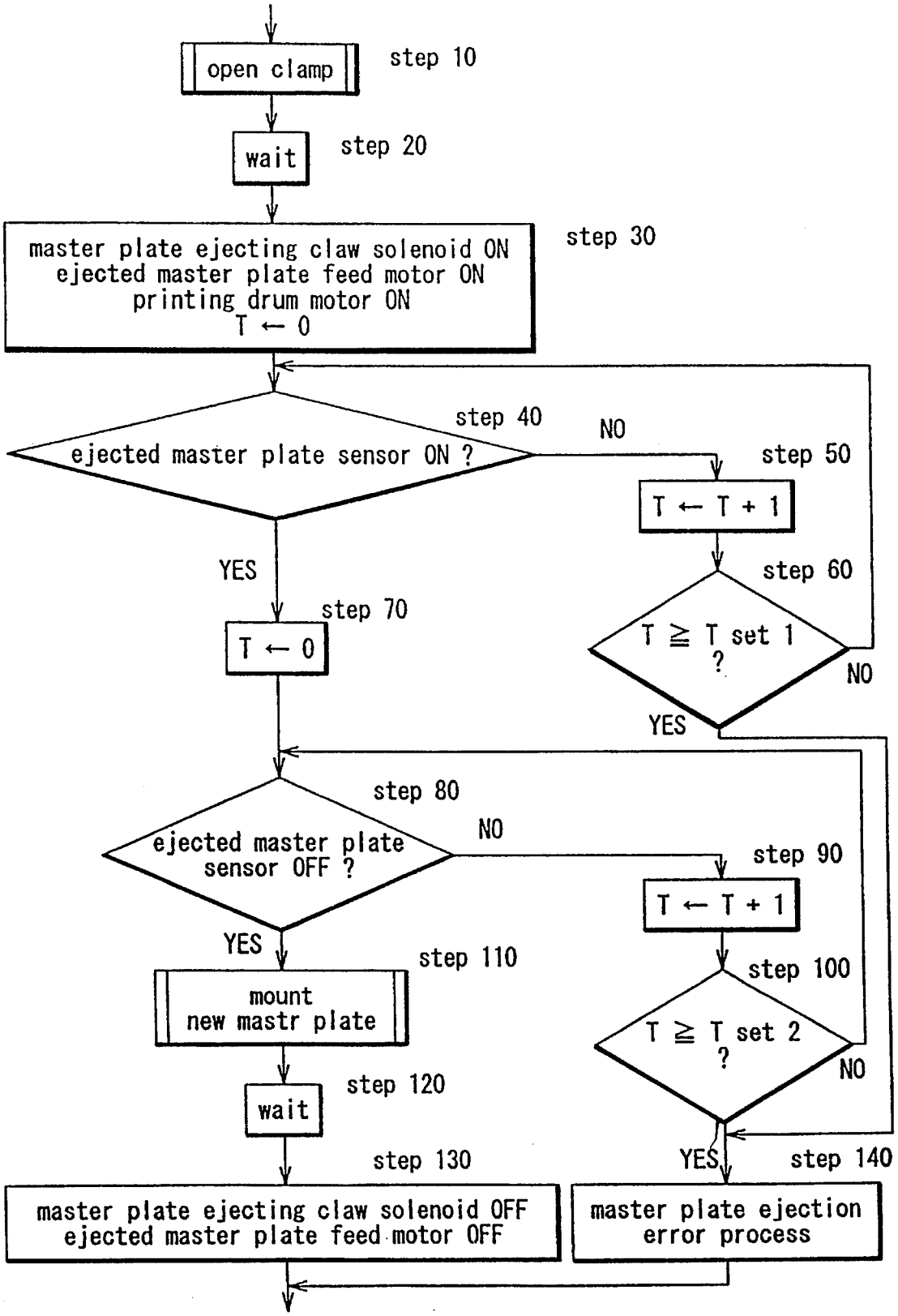
FIG. 3 is a flow chart showing the process of ejecting a master plate in the stencil printing device equipped with a master plate ejecting device according to the present invention.
Figure 4:
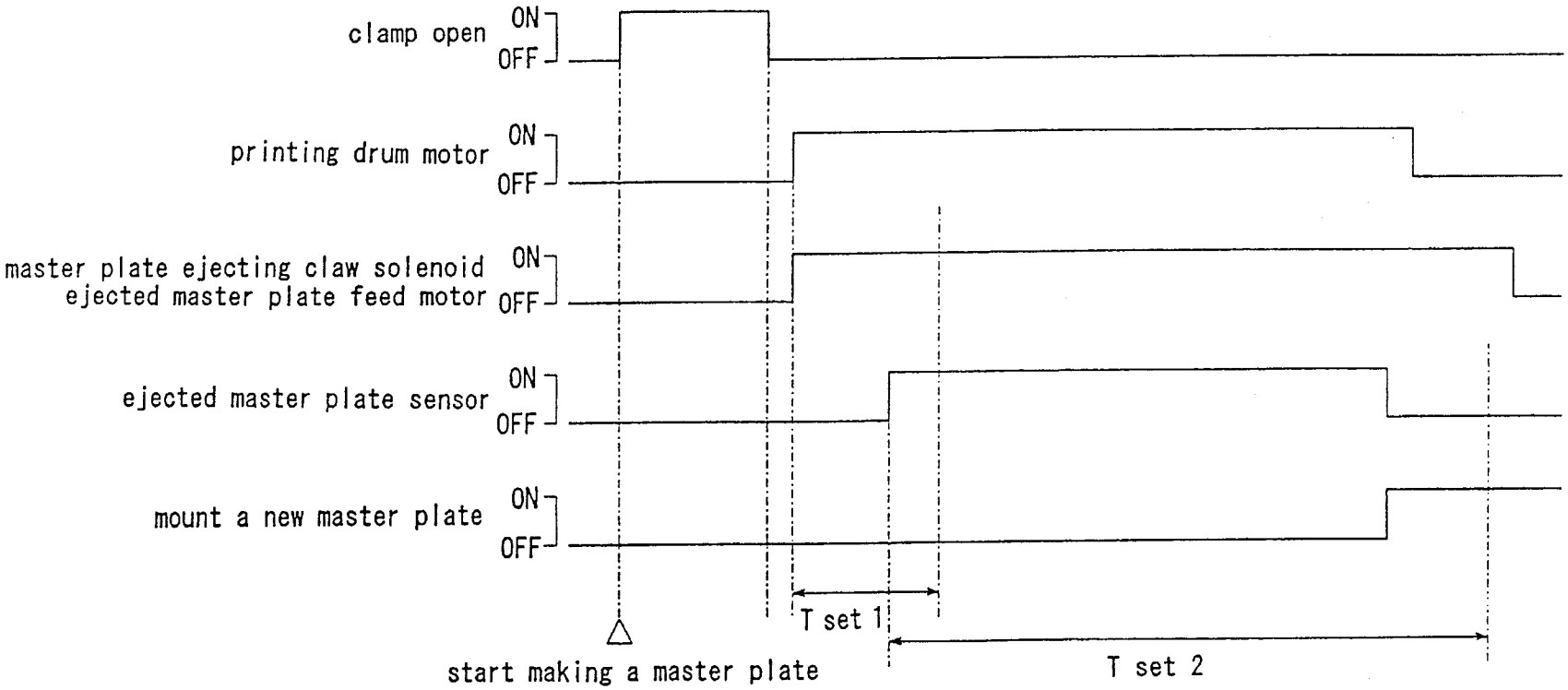
FIG. 4 is a time chart showing the process of ejecting a master plate in the stencil printing device equipped with a master plate ejecting device according to the present invention.

FIG. 3 shows a control flow for ejecting a master plate. FIG. 4 is a time chart showing the process of ejecting a master plate. The process of ejecting a master plate is started by the pressing of a plate making start switch provided in a control panel not shown in the drawing by the user. First of all, the clamp solenoid 11 is turned on to mesh the drive gear 15 with the gear 9 of the printing drum 1 which is stationary at its initial angular position, and the clamp motor 99 is activated to carry out the process of clamp opening by moving the master plate sheet clamping piece 5 to a clamp release position (step 10).

When this clamp opening process is completed, and a time period sufficient to disengage the drive gear 15 from the gear 9 by the action of the clamp solenoid 11 has elapsed (step 20), the process of ejecting a master plate is started.

The process of ejecting a master plate is carried out by turning on the master plate ejecting claw solenoid 59 to move the master plate ejecting claw 51 to the position for peeling off the master plate sheet from the printing drum, turning on the ejected master plate feed motor 101 to rotate the master plate ejecting feed rollers 53 and 55, and turning on the printing drum motor 95 to rotate the printing drum 1. In synchronism with each step of turning on a motor or a solenoid, the timer value T of the CPU 71 is reset to zero (step 30).

As a result, the stencil master plate S mounted around the outer circumferential surface of the printing drum 1 is peeled off by the master plate ejecting claw 51 as the printing drum 1 rotates, and the removed master plate is engaged by the master plate ejecting feed rollers 53 and 55, and is delivered to the ejected master plate receiving box 57.

As described above, when the master plate ejection process is started, it is determined if the state of the ejected master plate sensor 61 has changed from the one indicating the absence of a master plate to the one indicating the presence of a master plate or, more specifically, if the output signal of the ejected master plate sensor 61 has changed from OFF to ON within a prescribed time period determined by a timer set value Tset1, for instance two seconds after the master plate ejection process is started (steps 40, 50 and 60).

If the output signal of the ejected master plate sensor 61 does not change from OFF to ON within a prescribed time period determined by the timer set value Tset1, as it is likely that the leading edge of the stencil master plate S to be ejected may have not passed the master plate ejecting feed rollers 53 and 55 due to jamming or the like, a master plate ejection error process is carried out, and the start of the succeeding process is suspended while a command indicating a failure to properly eject a master plate is sent to the display drive circuit 93 (step 140). As a result, the display unit 107 displays the occurrence of an unsatisfactory ejection of a master plate.

On the other hand when the output signal of the ejected master plate sensor 61 has changed from OFF to ON within a prescribed time period determined by the timer set value Tset1 after the start of the master plate ejecting process, as it means that the leading edge of the stencil master plate S to be ejected has properly passed through the master plate ejecting feed rollers 53 and 55, the time value T is reset to zero by the CPU 71 (step 70), and it is determined if the state of the ejected master plate sensor 61 has thereafter changed from the one indicating the presence of a master plate to the one indicating the absence of a master plate or, more specifically, if the output signal of the ejected master plate sensor 61 has changed from ON to OFF within a prescribed time period determined by a timer set value Tset2, for instance ten seconds after the timer has been reset (steps 80, 90 and 100).

If the output signal of the ejected master plate sensor 61 did not change from ON to OFF within the prescribed time period determined by the timer set value Tset2 after the output signal of the ejected master plate sensor 61 has changed to ON, as it means that the trailing edge of the stencil master plate S to be ejected has not passed the master plate ejecting feed rollers 53 and 55 due to jamming or the like, a master plate ejection error process is carried out, and the start of the succeeding process is suspended while a command indicating a failure to properly eject a master plate is sent to the display drive circuit 93 (step 140). As a result, the display unit 107 displays the occurrence of an unsatisfactory ejection of a master plate.

On the other hand, if the output signal of the ejected master plate sensor 61 has changed from ON to OFF within the prescribed time period determined by the timer set value Tset2 after the output signal of the ejected master plate sensor 61 has changed to ON, as it means that the trailing edge of the stencil master plate S to be ejected has properly passed the master plate ejecting feed rollers 53 and 55, and the master plate ejection process has been successfully completed, a newly prepared master plate S is immediately mounted on the outer circumferential surface of the printing drum 1 simultaneously as the used stencil master plate is ejected (step 110). As a result, the sooner the output signal of the ejected master plate sensor 61 has changed from ON to OFF or the sooner the master plate ejection is satisfactorily completed, the sooner the next master plate can be mounted, and the next printing process can be started.

Upon elapsing of a prescribed time period, for instance two seconds from the time point at which the output signal of the ejected master plate sensor 61 changed from ON to OFF (step 120), the master plate ejecting claw solenoid 69 is turned off to restore the master plate ejecting claw 51 back to its retracted position, and the ejected master plate feed motor 101 is turned off to stop the rotation of the master plate ejecting feed rollers 53 and 55, thus completing the process of ejecting a master plate (step 130).

Although the present invention has been described in terms of a specific embodiment thereof, it is obvious to a person skilled in the art that various alterations and modifications are possible without departing from the scope of the present invention which is set forth in the appended claims.

As can be understood from the above description, according to the stencil printing device equipped with a master plate ejecting device, it is monitored if a change of the state of the stencil master plate detecting means, for instance consisting of a ejected master plate sensor from a state indicating absence of a stencil master plate to a state indicating presence of a stencil master plate is followed within a prescribed time period by a change of the state of the stencil master plate detecting means from the state indicating presence of a stencil master plate to the state indicating absence of a stencil master plate or, in other words, the passage of the trailing edge of the master plate to be ejected is monitored. If the passage of the trailing edge of the master plate to be ejected is not detected, a start of a next operation is prohibited as a case of a failure to properly eject a stencil master plate, and the master plate ejection failure warning means issues a warning indicating an occurrence of a failure to properly eject a stencil master plate. Thus, a failure to properly eject a stencil master plate can be reliably and correctly detected, and secondary failures due to the occurrence of a failure to properly eject a stencil master plate can be avoided. Also, the user is warned of the occurrence of a failure to properly eject a stencil master plate in an accurate fashion.

Although the present invention has been described in terms of a specific embodiment thereof, it is possible to modify and alter details thereof without departing from the spirit of the present invention.

What we claim is:

1. A stencil printing device equipped with a master plate ejecting device for removing a stencil master plate mounted around an outer circumferential surface of a printing drum and conveying it to an ejected master plate receiving unit, comprising:

a singular stencil master plate detecting sensor for detecting presence or absence of a stencil master plate in a path for conveying a stencil master plate to said stencil master plate receiving unit; and control means for monitoring if a first change of a state of said stencil master plate detecting sensor from a state indicating absence of a stencil master plate to a state indicating presence of a stencil master plate is followed within a prescribed time period by a second change of a state of said stencil master plate detecting sensor from a state indicating presence of a stencil master plate to a state indicating absence of a stencil master plate so that a start of a next operation is permitted when such a sequence of said first change and said second change of a state of said stencil master plate detecting sensor takes place, and a start of a next operation is otherwise prohibited as being a case of a failure to properly eject a stencil master plate.

2. A stencil printing device according to claim 1, wherein each of said first change and said second change is determined when said stencil master plate removed from said printing drum has passed through a prescribed point on said path for conveying a stencil master plate.

3. A stencil printing device according to claim 2, said first change being determined when a leading edge of said stencil master plate removed from said printing drum has passed through said prescribed point, and said second change being determined when a trailing edge of said stencil master plate removed from said printing drum has passed through said prescribed point.

4. A stencil printing device according to claim 1, further comprising a stencil master plate ejection failure warning means for indicating a failure to properly eject a stencil master plate when such a failure is detected by said control means.

5. A stencil printing device equipped with a master plate ejecting device for removing a stencil master plate mounted around an outer circumferential surface of a printing drum and conveying it to an ejected master plate receiving unit, comprising:

a singular stencil master plate detecting sensor for detecting presence or absence of a stencil master plate in a path for conveying a stencil master plate to said stencil master plate receiving unit; and control means for monitoring if a first change of a state of said stencil master plate detecting sensor from a state indicating absence of a stencil master plate to a state indicating presence of a stencil master plate is followed within a prescribed time period by a second change of a state of said stencil master plate detecting sensor from a state indicating presence of a stencil master plate to a state indicating absence of a stencil master plate so that a start of a next operation is immediately permitted without awaiting a lapse of said prescribed time period when such a sequence of said first change and said second change takes place, and a start of a next operation is otherwise prohibited as being a case of a failure to properly eject a stencil master plate.

6. A stencil printing device according to claim 5, wherein each of said first change and said second change is determined when said stencil master plate removed from said printing drum has passed through a prescribed point on said path for conveying a stencil master plate.

7. A stencil printing device according to claim 6, said first change being determined when a leading edge of said stencil master plate removed from said printing drum has passed through said prescribed point, and said second change being determined when a trailing edge of said stencil master plate removed from said printing drum has passed through said prescribed point.

8. A stencil printing device according to claim 5, further comprising a stencil master plate ejection failure warning means for indicating a failure to properly eject a stencil master plate when such a failure is detected by said control means.

* * * * *